US011242573B2

(12) United States Patent
Koenig et al.

(10) Patent No.: US 11,242,573 B2
(45) Date of Patent: Feb. 8, 2022

(54) PROCESS AND SYSTEM FOR PROCESSING AQUEOUS SOLUTIONS

(71) Applicant: BEPEX INTERNATIONAL, LLC, Minneapolis, MN (US)

(72) Inventors: Peter M. Koenig, Minneapolis, MN (US); Charles Louis Ley, Richfield, MN (US); Michael Guy Morin, Columbia Heights, MN (US); John Marvin Heapy, North Saint Paul, MN (US); Andrei Bortnov, Vadnais Heights, MN (US)

(73) Assignee: Bepex International, LLC, Minneapolis, MN (US)

( * ) Notice: Subject to any disclaimer, the term of this patent is extended or adjusted under 35 U.S.C. 154(b) by 0 days.

(21) Appl. No.: 15/738,855

(22) PCT Filed: Jun. 23, 2016

(86) PCT No.: PCT/US2016/039074

§ 371 (c)(1),
(2) Date: Dec. 21, 2017

(87) PCT Pub. No.: WO2016/210169

PCT Pub. Date: Dec. 29, 2016

(65) Prior Publication Data

US 2018/0187275 A1 Jul. 5, 2018

Related U.S. Application Data

(60) Provisional application No. 62/183,274, filed on Jun. 23, 2015.

(51) Int. Cl.

| | |
|---|---|
| ***C13B 25/04*** | (2011.01) |
| ***C13B 30/02*** | (2011.01) |
| ***C13B 40/00*** | (2011.01) |
| ***F26B 3/20*** | (2006.01) |

(52) U.S. Cl.
CPC ..... *C13B 25/04* (2013.01); *C13B 30/02* (2013.01); *C13B 30/028* (2013.01); *C13B 40/002* (2013.01); *F26B 3/20* (2013.01)

(58) Field of Classification Search
CPC ..... C13B 25/04; C13B 30/02; C13B 40/002; C13B 30/022; C03B 30/028;
(Continued)

(56) References Cited

U.S. PATENT DOCUMENTS

| | | |
|---|---|---|
| 2,595,679 A | 5/1952 | Lew |
| 3,207,818 A | 9/1965 | Marshall |

(Continued)

FOREIGN PATENT DOCUMENTS

| | | |
|---|---|---|
| DE | 102004027196 A1 | 12/2005 |
| EP | 0737753 A2 | 10/1996 |
| WO | 2008080788 A2 | 7/2008 |

OTHER PUBLICATIONS

PCT International Search Report and Written Opinion dated Jun. 27, 2016 for Intl. App. No. PCT/US2016/039074, from which the instant application is based, 14 pgs.

*Primary Examiner* — Claire A Norris
(74) *Attorney, Agent, or Firm* — Fredrikson & Byron, P.A.

(57) ABSTRACT

A system can be used to process liquid materials, such as aqueous-based syrup solutions containing sugar molecules. In some examples, the system includes a processing vessel having multiple individually-controllable temperature zones arranged in series. In operation, an aqueous solution can be introduced into an inlet port of the processing vessel and passed sequentially through the series of temperature zones. Water from the aqueous solution can be evaporated within the initial stage(s) of the processing vessel to form a concentrated solution that is then cooled in subsequent stage(s). Accordingly, a supersaturated solution may be formed from
(Continued)

the aqueous solution in the processing vessel that is then solidified to subsequently form a substantially dry solid material (e.g., sugar), still within the processing vessel. The substantially dry solid material can discharge through an exit port of the processing vessel.

12 Claims, 3 Drawing Sheets

(58) Field of Classification Search
CPC .... B01J 2219/00085; B01J 2219/00094; B01J 2219/00121; B01D 9/0013; B01D 9/004; F26B 25/006; F26B 3/20
USPC ..... 127/16, 58; 426/492, 660
See application file for complete search history.

(56) References Cited

U.S. PATENT DOCUMENTS 4,468,409 A * 8/1984 Metzroth ..... A23G 3/0226 127/16
5,410,984 A 5/1995 Pikus et al.
5,516,880 A 5/1996 Walsh
5,662,870 A 9/1997 Walsh
6,098,307 A 8/2000 Pikus et al.
6,340,738 B2 1/2002 Shimoda et al.
6,872,414 B1 3/2005 Myers et al.
7,771,493 B2 8/2010 Busch et al.
8,080,196 B2 12/2011 Martin et al.
8,293,018 B2 10/2012 Koenig et al.
8,323,360 B2 12/2012 Baran, Jr. et al.
8,518,738 B2 8/2013 Sirringhaus et al.
8,865,093 B2 10/2014 Lee et al.
9,243,017 B2 1/2016 Aslan
9,284,659 B2 3/2016 Betzel et al.
9,296,837 B2 3/2016 Wang et al.
2007/0069415 A1 3/2007 Moriyama et al.
2010/0275907 A1* 11/2010 Mantelatto ..... B01D 9/0013 127/16
2014/0256990 A1* 9/2014 Moen ..... B01D 1/225 568/868
2014/0376327 A1 12/2014 Fleury et al.

* cited by examiner

PROCESS AND SYSTEM FOR PROCESSING AQUEOUS SOLUTIONS

RELATED APPLICATIONS

This application is a 35 U.S.C. 371 national stage filing from International Application No. PCT/US2016/039074, filed Jun. 23, 2016, which claims priority to U.S. Provisional Application No. 62/183,274, filed Jun. 23, 2015. The entire contents of these applications are incorporated herein by reference.

TECHNICAL FIELD

This disclosure generally relates to systems and processes for processing liquid feeds, such as aqueous solutions, into solid products.

BACKGROUND

In the manufacture of sugar products, a process known as the transforming process has commonly been used to convert syrups into an array of dry sugar products. Such sugar products are often granular, free-flowing, non-caking, and readily dispersed or dissolved in water. Often, the process involves forming a supersaturated solution from the syrup in one vessel, then transferring the solution to a second vessel, where it can be cooled in order to crystallize a powder.

Applicant itself is a leader in the production of food and chemical processing equipment and systems that include thermal processing, polymer processing, drying, agglomeration, size reduction, compaction, briquetting, liquid/solid separation, mixing and blending for the food, chemical and polymer markets. Included within such equipment are Applicant's Solidaire® Drying System, which can be used for various purposes, e.g., to process heat-sensitive materials ranging from free-flowing solids to wet cakes and slurries.

SUMMARY

In general, the present disclosure is directed to systems, devices, and techniques for processing liquid materials to convert the liquid materials to substantially dry materials, such as granules and/or powers. In some examples, the liquid is concentrated within a processing vessel by heating the liquid and vaporizing a solvent and subsequently cooling the heated liquid within a downstream region of the same processing vessel. Example liquid materials that may be processed include solutions and/or slurries having a solute dissolved within a solvent, including syrups, polymers, minerals and ionic or non-ionic salts dissolved in liquids. In one specific example, the liquid being processed is a sugar solution containing sugar molecules (e.g., monosaccharides such as glucose and fructose, disaccharides such as sucrose, and/or longer chain oligosaccharides) dissolved in a solvent (e.g., water).

In some examples, an aqueous solution being processed is heated within a processing vessel to vaporize solvent from the aqueous solution being processed. As the solvent (e.g., water) vaporizes, the solute in the residual aqueous solution being processed is concentrated, thereby forming an aqueous solution with a concentrated solute. Thereafter, the aqueous solution with concentrated solute can be cooled within the processing vessel. In some applications, the aqueous solution with concentrated solute is cooled to a temperature below the temperature at which saturation for the solute occurs, thereby forming a supersaturated solution of the solute. The supersaturated solution can be solidified, with or without further drying, to form a dry or substantially dry solid material. Depending on the configuration of the system, a single processing vessel may sequentially heat and then cool the aqueous solution being processed within the interior of the vessel, for example as a continuous flow a material moves from an inlet to an exit of the processing vessel, thereby forming the supersaturated solution and subsequently crystallizing the solute out of solution within the same processing vessel.

In one example, a system is configured to form a supersaturated solution by heating and drying a syrup, followed by cooling the supersaturated solution in order to crystallize it, in order to form a substantially dry material. Both the heating/drying and the cooling stages in such a system can be performed within a single apparatus, for instance, within a dryer (e.g., paddle dryer) having a plurality of zones providing differing conditions (e.g., temperature, time, pressure, gas/vapor composition, shear rate). For instance, the apparatus may have a plurality of zones provided by means that include the use of similar or identical structures (e.g., jackets). In an alternative configuration, the plurality of zones are provided by two or more different structures, including for instance, jackets that are designed differently, so as to accommodate different heating/cooling media. Independent of the specific configuration, the apparatus or processing vessel, may have multiple of jacket configurations, in order to provide for both heating (e.g., by steam) and for cooling (e.g., by water).

In general, the disclosed systems and techniques can be used to process any desired liquid materials, including both aqueous and non-aqueous solutions. In some applications, an aqueous solution is processed which contains a sufficient amount of solute to increase the viscosity of the solution compared to the viscosity of the solvent in which the solute is dissolved, and therefore is referred to herein as a viscous feed material. For example, the aqueous solution being processed may be a syrup.

In general, a syrup includes crystalline solids dissolved in an aqueous solution. As used herein, the term "syrup" generally refers to a viscous carbohydrate containing solution or suspension having a substantially high solids content (e.g., between about 60 and about 75%, by weight). In processing, the syrup can be converted first to supersaturated solution (e.g., by vaporization of volatiles in the liquid material), and in turn, solidified (e.g., crystallized) to form a substantially dry material (e.g., powder or granules). Alternatively, the suspension can have less than 10% or greater than 75% solids at elevated temperatures. Example syrups include, but are not limited to, natural and other sweeteners, including fruit nectars, honey, molasses, fruit (e.g., agave) syrup, maple syrup, and combinations thereof. In another exemplary embodiment, the aqueous solution includes fruit juice, sugar cane juice (e.g., cane juice), and/or beet juice, any one of which may contain sucrose and maltose. Upon being processed, the resulting dry or semi-dry material may a solid sugar, such as powdered or granular sugar.

The details of one or more examples are set forth in the accompanying drawings and the description below. Other features, objects, and advantages will be apparent from the description and drawings, and from the claims.

DETAILED DESCRIPTION

The present disclosure is generally directed to systems, devices, and techniques for processing liquid feedstocks containing solubilized components that are desirably extracted to provide a dried form of the previously-solubilized components. In some applications, the liquid feedstock is a sugar-containing aqueous solution that is processed to separate sugar molecules from a water-based carrier solvent to provide dried sugar. The liquid feedstock can be conveyed through a processing vessel having multiple temperature zones aligned in series to sequentially heat the feedstock, evaporating water to increase the concentration of sugar in the feedstock, and then cool the feedstock to form a supersaturated solution. Upon causing nucleation of the supersaturated solution, supersaturated sugar solution can crystalize.

Figure 1:
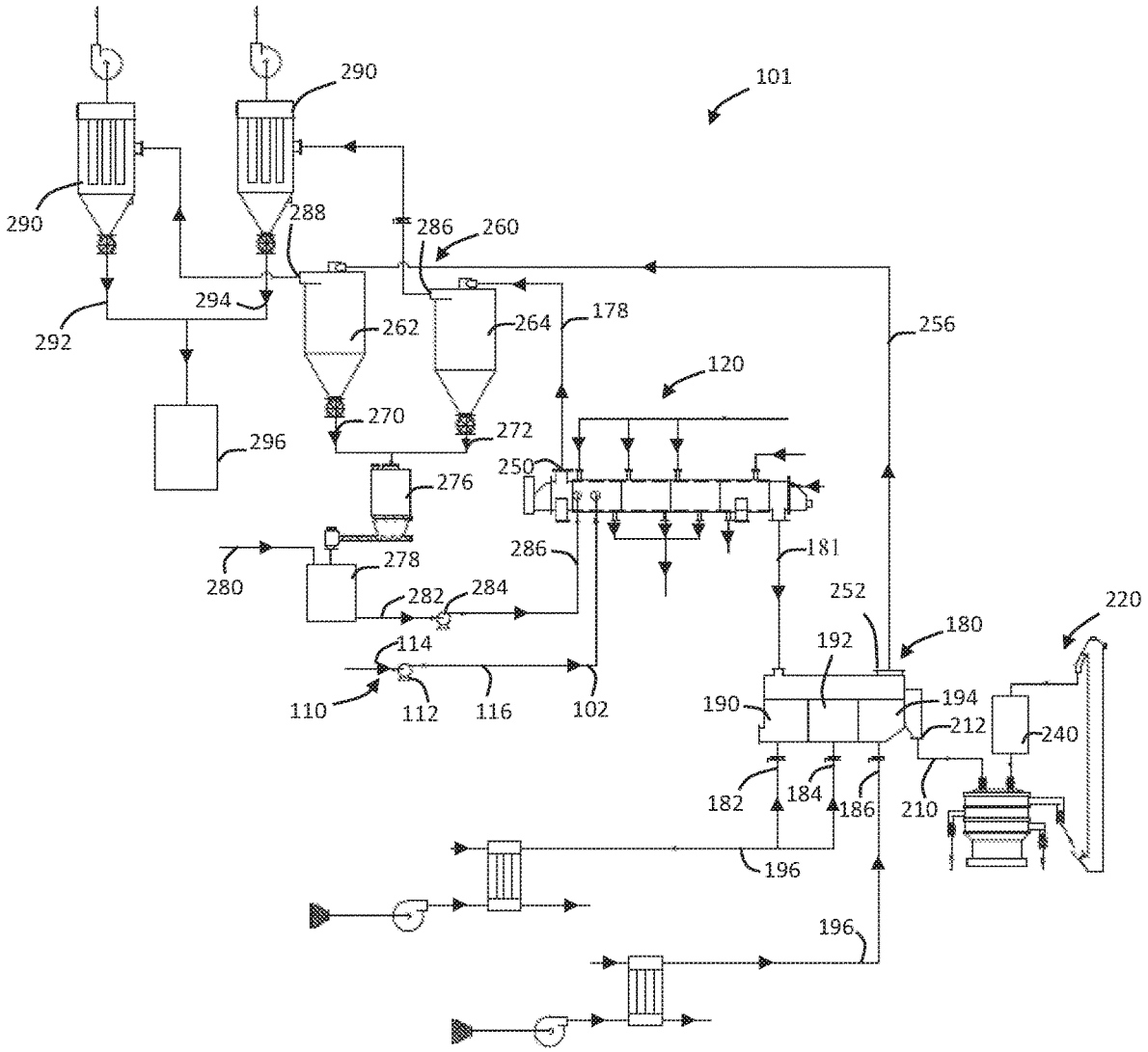
FIG. 1 is a schematic view of one example processing system for obtaining a crystalline product from a liquid feed.

FIG. 1 is a schematic illustration of an example system 101 for processing a liquid feedstock in accordance with the disclosure. System 101 includes a material deliver apparatus 110, a process vessel 120, a secondary conditioning vessel 180, and a solid product collection system 220. System 101, and the processing equipment utilized within the system, can have a variety of configurations and arrangements.

Processing Apparatus

In the example of FIG. 1, system 101 includes a material delivery apparatus 110. The material delivery apparatus 110 can continuously deliver a feed material (including any of the feed materials described herein) via a feed delivery pump 112, which pressurizes the feed material. In some examples, the material delivery apparatus 110 includes a storage tank configured for receiving feed via one or more discharge valves. The feed can be initially received from a shipping container (e.g., tote, tank car) and discharged to the storage tank via gravity. The material delivery apparatus 110 can pressurize the feed material in the feed delivery pump 112. Optionally, one or more filters can be included at or upstream of the inlet 114 of the feed delivery pump 112 to prevent solids from entering the pump.

In operation, the pressurized feed 102 can be fed (e.g., continuously or intermittently) from the outlet 116 of the feed delivery pump 112 into a process vessel 120 via one or more nozzles and/or associated fluid control components (e.g., valves, meters, and the like) to deliver a predetermined rate of feed material. The feed can be delivered continuously into the process vessel 120. The process vessel 120 can operate at atmospheric or non-atmospheric pressure (e.g., above or below atmospheric pressure). For example, the process vessel 120 may be operated at vacuum pressure to lower the operating temperature of the system (e.g., by lowering the boiling point of the feed stock) than at atmospheric pressure, thereby facilitating crystallization of heat-sensitive crystalline products such as dextrose.

Figure 2A:
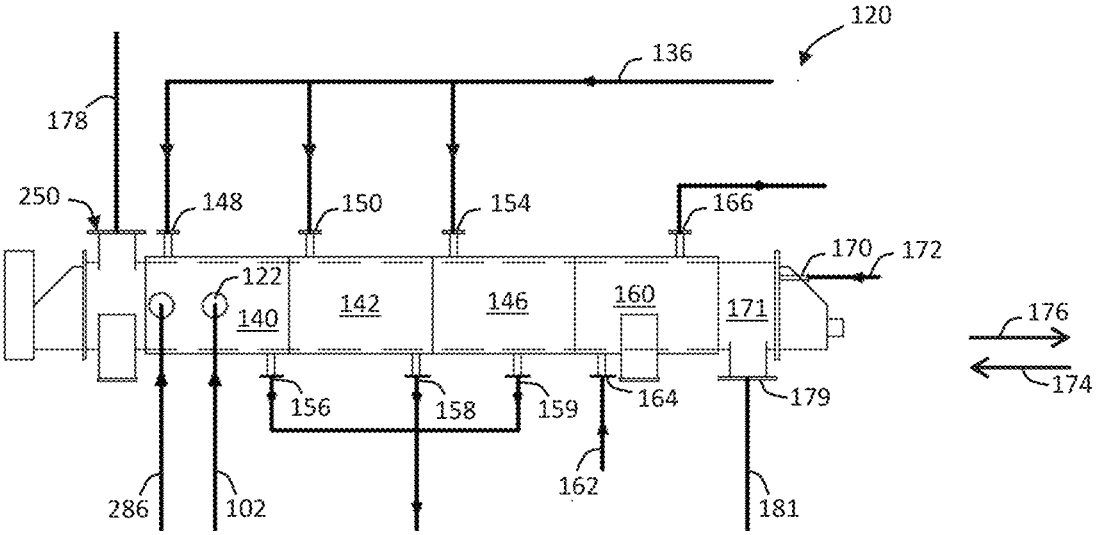
FIG. 2A is a schematic view of a two zone process vessel that can be used in the example system of FIG. 1.

The process vessel 120 can have multiple temperature zones arranged in series that can each be configured to heat, evaporate (dry), and/or a cool/crystallize the material being processed. For example, the processing vessel 120 may have designed to heat the material being processed to a temperature above the boiling point of the material and, downstream, cool the concentrated material to crystalize concentrated solids in the material. In some examples, the heating, evaporating and cooling/crystallizing occur within a single process vessel 120. In various examples, process vessel 120 may include rotating discs, paddles, rotors, and/or screws to convey material from one end of the process vessel to an opposite end of the process vessel. One example configuration of process vessel 120 that can be used in system 101 is illustrated in FIG. 2A. Additional details on example configurations of process vessel 120 that can be used in some embodiments of the disclosure are described in U.S. Pat. Nos. 8,293,018 and 6,098,307, the contents of which are incorporated herein by reference.

Figure 2B:
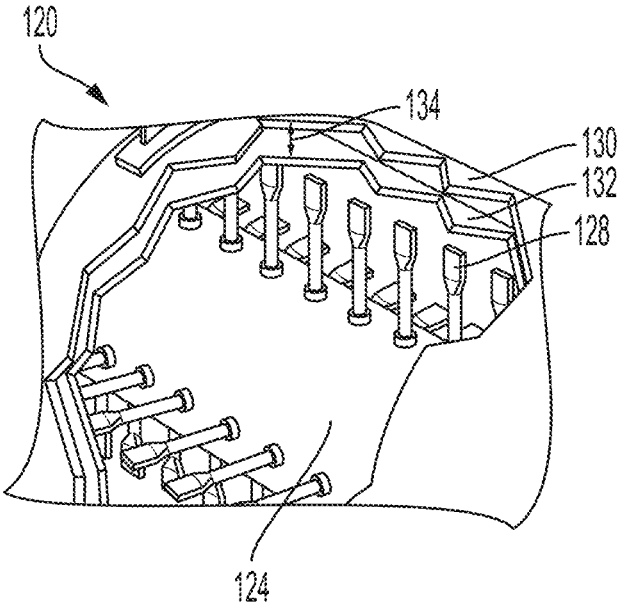
FIG. 2B is a schematic view of a portion of the two-zone process vessel of FIG. 2A showing an example configuration of components.

FIG. 2B illustrates a schematic view of an example configuration of the process vessel 120. In the illustrated configuration, the process vessel 120 has a cylindrical body with a centrally mounted rotor 124 upon which a plurality of adjustable-pitch paddles 128 (e.g., which may be fixed in a predetermined orientation to facilitate cleaning) are disposed. This arrangement is further illustrated in FIG. 2C. In some configurations, the paddles of the process vessel 120 can be adjusted to control residence time of the product formed from the feed material. Optionally, the speed of rotation of the rotor can also be adjusted to keep material in constant, agitated contact. Such exemplary embodiments may help prevent formation of "dead zones" due to turbulent motion, thereby preventing the feed material from stagnating.

Figure 2C:
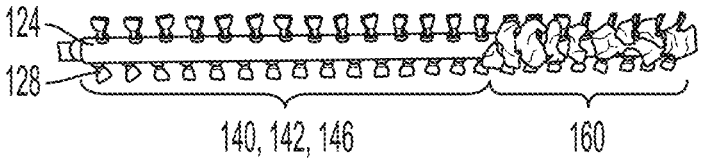
FIG. 2C is a view of an example paddle rotor that can be used in the process vessel of FIGS. 2A and 2B.

With further reference to FIGS. 2B and 2C, the process vessel 120 in the illustrated example includes an outer wall (e.g., referred to as a jacket 130) and inner wall 132, forming an annular gap 134 therebetween. A first heat-transfer medium 136 can be circulated in the annular gap 134 between the jacket 130 and the inner wall 132 of the process vessel 120. As such, the heat-transfer between the feed material and the heat-transfer medium in the process vessel 120 may occur indirectly (e.g., without any contact between feedstock passing through the process vessel 120 and the heat-transfer medium).

In some configurations, the process vessel 120 includes multiple temperature zones. For example, in the illustrated embodiment, the process vessel 120 includes three "heating" zones 140, 142, 146. In operation, a first heat-transfer medium 136 (e.g., vapor such as steam, liquid such as hot water or electric heat transfer medium) is circulated in the annular gap 134 between the inner wall 132 and jacket 130 of the process vessel 120 via respective inlet ports 148, 150, 154. The first heat transfer medium leaves the process vessel 120 via respective outlet ports 156, 158, and 159. Additional or fewer heating zones are contemplated within the scope of this application.

The first heat-transfer medium 136 in the heating zones can be at a temperature sufficient to cause the feed material to reach its boiling point, thereby evaporating aqueous carrier solvent and concentrating residual solute. The feed material can be heated to a temperature and for a duration sufficient to cause the feed material to have a solute concentration that, when subsequently cooled, forms a supersaturated solution. In one example, the first heat-transfer medium 136 can have a temperature between about 130° C. and about 200° C. In applications where process vessel 120 operates at vacuum pressure, the boiling point of the feed stock is lowered compared to atmospheric pressure. In such cases, the temperature and pressure of the first heat transfer medium (e.g., steam) may or may not be less than when the process vessel is operated at or above atmospheric pressure. Additionally, the temperature of each heating zone 140, 142 and 146 can be controlled such that each heating zone 140, 142, 146 can have a temperature that is the same as or different than any of the other heating zones 140, 142, 146.

The process vessel 120 can also include a cooling zone 160. In operation, a second heat-transfer medium 162 (e.g., cool, cold, chilled liquid such as water, glycol and the like) may be circulated in annular gap 134 between the jacket 130 and the inner wall 132 of the process vessel 120 via a separate inlet and outlet ports 164, 166. As is the case with the heating zones, additional or fewer cooling zones are contemplated.

In embodiments having multiple cooling zones, each cooling zone can have a temperature different from the temperature of other cooling zones. The second heat-transfer medium 162 in the cooling zone may have a temperature less than 40° C. In some examples, the second heat-transfer medium 162 in the cooling zone is at a temperature ranging from about −10° C. to about 40° C. such as from about 5° C. to 30° C. The second-heat transfer medium 162 can have any temperature such that the product dispensed from the process vessel has a moisture content of about less than 3%.

The jacket 130 of the heating zones can be of a suitable design (e.g., dimpled or non-dimpled). In some examples, the cooling zone has a plurality of plates along the length of the process vessel 120 that act as baffles for the second heat-transfer medium 162 in the cooling zone. Such a design advantageously prevents the second heat-transfer medium 162 in the cooling zone from being short-circuited (thereby moving from one port, such as the inlet port 164 to outlet port 166) and thereby improving heat transfer in the process vessel 120.

The length of the heating zones and the cooling zones can be chosen so as to maximize the area available for heat transfer in the heating and cooling zones. For example, as illustrated, the heating zones can be of a length between about two-thirds to about three-fourths of the overall length of the process vessel 120. Alternatively, the heating zones can be between 50% to about 80% of the length of the process vessel 120. By routing a different heat transfer medium through the annular gap between the jacket and the inner walls of the process vessel 120, any of the heating zones (e.g., heating zone 146) can be converted to a cooling zone and vice versa.

The process vessel 120 may also include the use of a sweep gas inlet 170 to purge supersaturated vapors from the process vessel 120. For example, as illustrated in FIG. 2A, a sweep gas 172 (e.g., compressed air or inert gases) can flow in a direction 174 opposing (e.g., counter-flow) to the direction of feed material flow 176 in the process vessel 120, entering via the sweep gas inlet 170 and exiting upstream of the entry point of the feed material in the process vessel 120. Such an embodiment can provide a flash cooling effect by evaporative and jacket cooling of the material leaving the final heating zone (e.g., melt or paste) and, in conjunction with the agitation caused by rotating paddles, rapidly forms flowable particles. Also, the sweep gas 172 may prevents condensation of water vapors (e.g., from the moisture removed from the feed material in the heating or cooling zones). The sweep gas 172 can convey fine solids suspended therein via the exhaust line 178 of the process vessel 120 into the solid recovery apparatus downstream of the process vessel 120 as will be described later below. Exhaust line 178 can be positioned between the feed inlet and product outlet.

The feed material can be heated to a supersaturated state in the heating zone(s) and subsequently flash cooled and solidified (e.g., crystallized) in a single process vessel 120, avoiding the need for separate vessels for evaporation (or drying) and cooling/crystallization. In some embodiments, the supersaturated solution is converted into slurry or a paste and ultimately crystallizes into powder form. The temperature and rotational speed of the paddles in the process vessel 120 can be controlled to form dried product of desired particle size. In one example, the product can have a moisture content of between about 1% and about 3% when discharged from the process vessel 120.

Referring back to FIG. 1, the crystallized product from the cooling zone is discharged (e.g., via gravity feed) from the discharge port 179 of the process vessel 120 and into a secondary conditioning apparatus 180. In one example, as illustrated in FIG. 1, the secondary conditioning apparatus 180 can be a dryer cooler such as a Fluid Bed Cooling System described in U.S. Pat. Nos. 5,516,880 and 5,662,870 both assigned to Bepex International L.L.C., the assignee of the instant application, the disclosure of each of which is hereby incorporated by reference. Other secondary conditioning apparatuses (e.g., a dryer conditioner such as a Thermascrew® Indirect Heating System from Bepex International L.L.C., the assignee of the instant application) are also contemplated. The secondary conditioning apparatus 180 can have gas streams entering via gas inlet ports 182, 184, and 186. The gas streams can be cross-flow streams that can rise in a vertical direction. The incoming crystalline product can be further cooled and dried due to the cross-flow gas streams.

Optionally, as is the case with the process vessel 120, the secondary conditioning apparatus 180 can also have heating and cooling zones 190, 192, 194. In the illustrated embodiment of FIG. 1, two heating zones 190, 192 and one cooling zone 194 is shown. The zones 190, 192, 194 can have indirect heat transfer coils. Additional or fewer heating or cooling zones are also contemplated within the scope of the application. The secondary conditioning apparatus 180 can also have a secondary heat-transfer medium 196 (e.g., air) circulating via ports 182, 184, 186 to further cool and dry the crystallized product received in the secondary conditioning apparatus 180. In such cases, the temperature of the secondary heat transfer medium in the heating zones of the secondary conditioning apparatus 180 can be between about 60° C. and about 150° C. The temperature of the secondary heat transfer medium in the cooling zones of the secondary conditioning apparatus 180 can be of a value such that the crystallized product has a temperature less than about 30° C. The secondary heat transfer medium in the cooling zone can have a temperature such that the crystallized product is of a temperature and a moisture content such that it does not agglomerate into large clumps or bricks during storage or packaging.

Once further dried and crystallized, the product 210 can be discharged out of the discharge port 212 of the secondary conditioning apparatus 180, and collected via a solid product collection system 220 (e.g., bagged into drums). The product can optionally be further processed (e.g., a mill 240) to obtain products having a desired size distribution. In some applications, the final product can have a moisture content of less than 1%. For example, the moisture content of the final product may no greater than 0.8% to be considered as "substantially dry" for the purposes of this application. The final product can have particle sizes of between about 10 microns and about 2000 microns, although other particle sizes are also possible.

Product Recycling System

With continued reference to FIG. 1, the process vessel 120 and the secondary conditioning apparatus 180 can each have an exhaust port 250, 252 for conveying a fraction of the solid product 178, 256 from each of the process vessel 120 and the secondary conditioning apparatus 180 to a solid recovery system 260. The fraction of the solid product can be determined based on the desired product size distribution and process parameters such as speed of rotation of the rotor of the process vessel 120, orientation of paddles in the process vessel 120, moisture content of the product in the cooling zones of the process vessel 120, sweep gas 172 velocity and the like. The solid recovery system 260 may include two separators 262, 264 (e.g., cyclone separators) to separate fine solids from each of the process vessel exhaust stream 178 and the secondary conditioning apparatus exhaust stream, 256, as shown in FIG. 1. The cyclone separators 262, 264 can separate fine suspended solids from the exhaust streams 178, 256 and discharge it (as discharge lines 270, 272) to a mixing tank 278 via a conveyor 276. The recovered solids from lines 270, 272 can then be mixed with a mixing medium 280 (e.g., water) to form a liquid feed (e.g., syrup) 282 and recycled back into the process vessel 120. Optionally, a recycle feed pump 284 can be provided to pressurize the recycled liquid feed prior to supplying it to the process vessel 120 as pressurized recycle feed 286. Another means of solid recovery which is collecting and recycling the fines could be through the use of a scrubber, in which a liquid is sprayed to capture/redissolve the fines which are then fed back.

In the configuration of FIG. 1, the separators each have an exhaust port 286, 288, leading to a filtration system 290 (e.g., baghouse filtration system 290). The filtration system 290 comprises several filters that can recover finer solids not recovered by the separators and store the recovered fine solids 292, 294 in a collection tank 296.

The follow example may provide additional details about systems, devices, and techniques in accordance with the disclosure

EXAMPLE

Description of Feed

The feed can be an aqueous solution of sucrose and water with average moisture content between about 20% and about 30%. The feed was initially held in a large tote.

Treatment Procedure

The feed tote can be positioned such that the aqueous solution is fed by gravity onto the inlet 114 of the pump 112. Optionally a filter can be used as a barrier to prevent crystals from falling into the pump. The syrup can be preheated by using water at temperatures between about 38° C. and about 45° C. The preheated syrup can be transferred into the first side port 122 of the Solidaire® paddle dryer via the pump 112. The syrup can be continuously fed at a rate between about 40 kg/h and about 90 kg/hr. The entire process can occur at a constant pressure, with a pressure drop not exceeding 1.0 mmHg (e.g., between about 0.1 mmHg and about 0.8 mmHg).

The heating zones 140, 142 of the Solidaire® paddle dryer can be heated with steam 136 circulating in the annular gap 134 between the jacket 130 and inner walls 132. The inlet temperature of steam in the heating zones 140, 142 can be between about 170° C. and about 180° C. In the instant example, the product can be cooled in cooling zones 146 and 160. The cooling zones 146,160 can be cooled using cold water. The inlet temperature of cold water in the cooling zones 146, 160 can be between about 10° C. and about 15° C.

Sweep gas 172 enters the Solidaire® paddle dryer at the sweep gas inlet port 170 proximal to the discharge end 171 of the Solidaire® so that its counter-current flow would purge water vapor out of the exhaust port. The rate of flow of sweep gas 172 can be between about 5 $NM^3/H$ and about 15 $NM^3/H$. The sweep gas 172 in this example can be filtered air from a compressed air line, and its flow rate can be controlled using a rotameter. To assist water vapor purge out of Solidaire®, an assembly of sanitary fittings from the baghouse filtration system was anchored to the exhaust port.

A slight negative pressure can be produced in the Solidaire® paddle dryer at the exhaust port 250 to reduce the amount of water vapor leaving the Solidaire® paddle dryer with the solid product at the discharge end. The rotor speed of the paddle dryer can be between about 700 rpm and about 800 rpm. The residence time of the material in the Solidaire® paddle dryer can be between about 2 minutes and about 5 minutes (e.g., 2 minutes at a feed rate of about 44 kg/hr).

Crystalline product 181 can be collected by gravity from the discharge port 179 of the Solidaire® paddle dryer into a Thermascrew® Indirect Heating System to further cool the crystalline product. The Thermascrew® Indirect Heating System can also have an outer jacket and an inner wall, and cold water is circulated in an annular gap therebetween. The flow of cold water therein can be counter-current, and an inlet temperature of between about 10° C. and about 15° C. Additionally, the Thermascrew® Indirect Heating System has a hollow rotor allowing flow of cold water therethrough. The rotor can be set to a low speed for thorough cooling. The crystalline product 210 can then be discharged by gravity into a plastic lined pail.

The product produced in accordance with the process above can have a temperature of between about 35° C. and about 45° C. and a moisture content of less than about 3.8% when discharged from the Solidaire® paddle dryer. Upon further cooling by the Thermascrew® Indirect Heating System, the product 210 can have a temperature of between about 20° C. and about 30° C.

Various examples have been described. These and other examples are within the scope of the following claims.

The invention claimed is:

1. A process for converting a liquid material to a substantially-dry material comprising:

providing a drying apparatus comprising:

an inner wall;

a jacket surrounding the inner wall and forming an annular gap therewith;

a centrally mounted rotor having paddles mounted thereon;

one or more heating zones having a first heat-transfer medium in the annular gap that is configured to heat a liquid in contact with the inner wall; and one or more cooling zones having a second heat-transfer medium in the annular gap that is configured to cool the liquid in contact with the inner wall supplying the liquid material into the drying apparatus such that the liquid material contacts the inner wall of the apparatus;

vaporizing volatiles in the liquid material by heating the liquid with the first heat-transfer medium to form a liquid with concentrated solute;

cooling the liquid with concentrated solute with the second heat-transfer medium to form a supersaturated liquid;

further cooling the supersaturated liquid to convert the supersaturated liquid to a substantially dry solid material; and discharging the substantially dry solid material from a discharge port of the apparatus.

2. The process according to claim 1, further comprising supplying a sweep gas proximal to the discharge port of the apparatus in a direction opposite to a direction in which the liquid material is fed, such that the volatiles are prevented from condensing in the heating or cooling zones of the drying apparatus.

3. The process of claim 1, wherein the solid material is crystallized in the drying apparatus.

4. The process according to claim 3, further comprising a secondary conditioning apparatus configured to cool crystalline material discharged from the drying apparatus to a temperature below 30° C.

5. The process according to claim 4, wherein the secondary conditioning apparatus dries the crystalline material such that the crystalline material has a moisture content not exceeding 1 wt %.

6. The process according to claim 4, wherein the crystalline material is cooled and dried by the secondary conditioning apparatus such that the particle size of the crystalline material is between about 10 microns and about 2000 microns.

7. The process according to claim 4, wherein the process occurs at non-atmospheric pressure.

8. The process according to claim 7, wherein the process occurs at vacuum pressure.

9. The process of claim 1, wherein the first heat-transfer medium has a temperature ranging from about 130 degrees Celsius to about 200 degrees Celsius.

10. The process of claim 1, wherein the second heat-transfer medium has a temperature ranging from about 5 degrees Celsius to about 40 degrees Celsius.

11. The process of claim 1, wherein discharging the substantially dry solid material from the discharge port of the apparatus comprises discharging the substantially dry solid material having from about 1 wt % to about 3 wt % moisture.

12. The process of claim 1, further comprising introducing a sweep gas into the apparatus, thereby evaporative flash cooling the liquid with concentrated solute in addition to cooling the liquid with concentrated solute with the second heat-transfer medium.

* * * * *